US007753792B2

(12) United States Patent
Walker et al.

(10) Patent No.: US 7,753,792 B2
(45) **Date of Patent: *Jul. 13, 2010**

(54) SYSTEM AND METHOD FOR AUTOMATED PLAY OF MULTIPLE GAMING DEVICES

(75) Inventors: Jay S. Walker, Ridgefield, CT (US); James A. Jorasch, Stamford, CT (US); Thomas M. Sparico, Hoboken, NJ (US)

(73) Assignee: IGT, Reno, NV (US)

( * ) Notice: Subject to any disclaimer, the term of this patent is extended or adjusted under 35 U.S.C. 154(b) by 1039 days.

This patent is subject to a terminal disclaimer.

(21) Appl. No.: 11/422,817

(22) Filed: Jun. 7, 2006

(65) Prior Publication Data

US 2006/0287038 A1 Dec. 21, 2006

Related U.S. Application Data

(63) Continuation of application No. 11/217,588, filed on Sep. 1, 2005, now Pat. No. 7,588,495, which is a continuation of application No. 10/159,722, filed on May 30, 2002, now Pat. No. 6,969,317, which is a continuation of application No. 09/879,299, filed on Jun. 12, 2001, now Pat. No. 6,634,942, which is a continuation-in-part of application No. 09/437,204, filed on Nov. 9, 1999, now Pat. No. 6,244,957, which is a continuation of application No. 08/774,487, filed on Dec. 30, 1996, now Pat. No. 6,012,983.

(51) Int. Cl.
*A63F 9/24* (2006.01)

(52) U.S. Cl. ..... 463/42; 463/16; 463/20; 463/25; 463/29

(58) Field of Classification Search ..... None
See application file for complete search history.

(56) References Cited

U.S. PATENT DOCUMENTS

| | | | | |
|---|---|---|---|---|
| 4,467,424 | A | 8/1984 | Hedges et al. | 364/412 |
| 4,636,951 | A | 1/1987 | Harlick | 364/412 |
| 4,764,666 | A | 8/1988 | Bergeron | 235/380 |
| 4,837,728 | A | 6/1989 | Barrie et al. | |
| 4,880,237 | A | 11/1989 | Kishishita | 273/138 |
| 4,951,039 | A | 8/1990 | Schwendeman et al. | |
| 5,326,104 | A * | 7/1994 | Pease et al. | 463/18 |
| 5,401,024 | A | 3/1995 | Simunek | 273/138 |
| 5,429,361 | A | 7/1995 | Raven et al. | 273/138 |
| 5,551,692 | A | 9/1996 | Pettit et al. | 273/143 R |
| 5,570,885 | A | 11/1996 | Ornstein | 463/27 |
| 5,655,961 | A * | 8/1997 | Acres et al. | 463/27 |

(Continued)

OTHER PUBLICATIONS

Office Action for U.S. Appl. No. 11/217,588 mailed Sep. 26, 2007, 12 pp.

(Continued)

*Primary Examiner*—M. Sager
(74) *Attorney, Agent, or Firm*—K&L Gates LLP

(57) ABSTRACT

A method according to one embodiment of the present invention provides for: receiving a request for an automated session, in which the automated session comprises a plurality of games; initiating a first game of the automated session, the first game corresponding to a first gaming device; and initiating a second game of the automated session, the second game corresponding to a second gaming device.

65 Claims, 10 Drawing Sheets

U.S. PATENT DOCUMENTS

| | | | | |
|---|---|---|---|---|
| 5,741,183 | A | 4/1998 | Acres et al. | 463/42 |
| 5,758,875 | A | 6/1998 | Giacalone, Jr. | 273/143 R |
| 5,761,647 | A * | 6/1998 | Boushy | 705/10 |
| 5,762,552 | A * | 6/1998 | Vuong et al. | 463/25 |
| 5,770,533 | A | 6/1998 | Franchi | 463/42 |
| 5,772,509 | A | 6/1998 | Weiss | 463/16 |
| 5,800,268 | A | 9/1998 | Molnick | 463/40 |
| 5,816,917 | A | 10/1998 | Kelmer et al. | 463/16 |
| 5,816,919 | A | 10/1998 | Scagnelli et al. | |
| 5,830,063 | A | 11/1998 | Byrne | |
| 5,830,067 | A | 11/1998 | Graves et al. | 463/40 |
| 5,971,851 | A * | 10/1999 | Pascal et al. | 463/24 |
| 5,999,808 | A * | 12/1999 | LaDue | 455/412.2 |
| 6,001,016 | A | 12/1999 | Walker et al. | 463/42 |
| 6,012,983 | A | 1/2000 | Walker et al. | 463/20 |
| 6,024,640 | A | 2/2000 | Walker et al. | |
| 6,186,893 | B1 * | 2/2001 | Walker et al. | 463/20 |
| 6,244,957 | B1 | 6/2001 | Walker et al. | 463/20 |
| 6,270,410 | B1 | 8/2001 | DeMar et al. | |
| 6,299,533 | B1 | 10/2001 | Parra et al. | 463/17 |
| 6,306,038 | B1 | 10/2001 | Graves et al. | 463/40 |
| 6,364,766 | B1 * | 4/2002 | Anderson et al. | 463/16 |
| 6,508,709 | B1 * | 1/2003 | Karmarkar | 463/42 |
| 6,508,710 | B1 | 1/2003 | Paravia et al. | |
| 6,634,942 | B2 * | 10/2003 | Walker et al. | 463/20 |
| 6,709,331 | B2 | 3/2004 | Berman | 463/16 |
| 6,969,317 | B2 * | 11/2005 | Walker et al. | 463/20 |
| 7,476,153 | B2 * | 1/2009 | Walker et al. | 463/20 |
| 7,524,244 | B2 * | 4/2009 | Walker et al. | 463/20 |
| 2002/0125641 | A1 | 9/2002 | Moody | 273/292 |
| 2003/0232651 | A1 | 12/2003 | Huard et al. | |

OTHER PUBLICATIONS

Brochure, "Flying Bet Roulette" DEQ Casinos Ltd., undated, 2pp.

Ritchie, Lauren "Orange Man Sought in Betting Probe", Orlando Sentinel Tribune, May 30, 1990 at p. B2, 3pp.

Mayo, Michael, "Win-Or-Lose-Cruise, You Can Bet Sports Legally Around Here—Just Wait Till the Boat is 3 Miles Out", Sun-Sentinel, Dec. 28, 1994 at p. 1C, 3pp.

Cave, Kathy, "The Lake Effect", Milwaukee Journal Sentinel, Mar. 27, 1996 at p. 8, 2pp.

Busch, Melanie, "Tulsa Firm Explores Internet Gaming", Tulsa World, Aug. 1, 1996, Section: Business, p. E1, 3pp.

"Electronic Bingo System", Network Gaming International Corporation, (http://network-bingocom/bingo htm), download date: Nov. 13, 1996, 5pp.

"MGAM Signs Agreement With Lac Vieux Desert Chippewa Tribe", Business Wire, May 18, 2001, 2pp.

"DEQ Casino—Flying Bet Roulette", (http //www deq com/ang/flying html), download date: Nov. 24, 2002, 1pg.

"GameCast Live—Home", (http //www gamecastlive com/), download date: Nov. 24, 2002, 1pg.

"GameCast Live—About the Product", (http //www gamecastlive com/about_the product html), download date: Nov. 24, 2002, 1pg.

"GameCast Live—PowerPoint Presentation", (http //www gamecastlive com/presentation/toronto2_files/frame htm), download date: Nov. 24, 2002, 12pp.

"GameCast Live—Press Release", (http //www gamecastlive com/press_june_6 html), download date: Nov. 24, 2002, 2pp.

"Welcome—i2corp.com", (http //www i2corp com/), download date: Nov. 24, 2002, 1pg.

"Games—i2corp.com", (http //www i2corp com/games/index cfm), download date: Nov. 24, 2002, 2pp.

"The Home Gambling Network—Welcome", (http //www homegamblingnetwork com), download date: Nov. 24, 2002, 1pg.

"The Home Gambling Network—Players", (http //www homegamblingnetwork com/player php3), download date: Nov. 24, 2002, 2pp.

"Multimedia Games, Inc.—Home", (http www betnet com/), download date: Nov. 24, 2002, 1pg.

* cited by examiner

446

| PLAYER ID 4460 | MACHINE ID NUMBER 4461 | LOCK START TIME 4462 | LOCK END TIME 4463 | MAXIMUM NUMBER OF PULLS 4464 | LIMITING CREDIT BALANCE 4465 | LIMITED MAXIMUM PAYOUT 4466 | BET PER PULL 4467 | TIME BETWEEN PULLS 4468 | COMM. DEVICE NUMBER 4469 |
|---|---|---|---|---|---|---|---|---|---|
| | | | | | | | | | |
| | | | | | | | | | |
| | | | | | | | | | |

FIG. 5

448

| COMMUNICATION DEVICE NUMBER 4480 | COMMUNICATOR IDENTIFIER 4481 | PLAYER ID 4482 | COMMUNICATION TIME OUT 4483 | COMMUNICATION TIME IN 4484 |
|---|---|---|---|---|
| | | | | |
| | | | | |
| | | | | |

FIG. 6

449

| MACHINE ID NUMBER 4491 | MACHINE TYPE 4492 | MACHINE DENOMINATIONS 4493 | MAXIMUM COINS 4494 | PAYOUT STRUCTURE 4495 | REEL POSITIONS 4496 | PAYOUT 4497 |
|---|---|---|---|---|---|---|
| | | | | | | |
| | | | | | | |
| | | | | | | |

FIG. 7

SYSTEM AND METHOD FOR AUTOMATED PLAY OF MULTIPLE GAMING DEVICES

CROSS-REFERENCE TO RELATED APPLICATIONS

This application is a continuation of U.S. patent application Ser. No. 11/217,588, entitled "METHOD AND HAND-HELD APPARATUS FOR FACILITATING REMOTE PLAY OF A SLOT MACHINE", filed Sep. 1, 2005 now U.S. Pat. No. 7,588,495 in the name of Walker et al.;

which is a continuation of U.S. patent application Ser. No. 10/159,722, entitled "SYSTEM AND METHOD FOR AUTOMATED PLAY OF MULTIPLE GAMING DEVICES," filed May 30, 2002, and issued as U.S. Pat. No. 6,969,317 On Nov. 29, 2005;

which is a continuation of U.S. patent application Ser. No. 09/879,299, entitled "SYSTEM AND METHOD FOR AUTOMATED PLAY OF MULTIPLE GAMING DEVICES," filed Jun. 12, 2001, and issued Oct. 21, 2003, as U.S. Pat. No. 6,634,942;

which is a continuation-in-part of U.S. patent application Ser. No. 09/437,204, entitled "AUTOMATED PLAY GAMING DEVICE," filed Nov. 9, 1999, and issued Jun. 12, 2001, as U.S. Pat. No. 6,244,957;

which is a continuation of U.S. patent application Ser. No. 08/774,487, entitled "AUTOMATED PLAY GAMING DEVICE", filed Dec. 30, 1996, and issued Jan. 11, 2000, as U.S. Pat. No. 6,012,983.

Each of the above-referenced applications is incorporated by reference herein in its entirety.

BACKGROUND OF THE INVENTION

1. Field of the Invention

The present invention relates generally to a method and apparatus for initiating and terminating automated play of a gaming device (or multiple gaming devices), such as a slot machine.

2. Description of Related Art

There are numerous types of gaming devices in use today. Most of these gaming devices, such as slot machines, video blackjack machines, video poker devices, or the like, require the player of the device to be physically present during game play. Specifically, the player must be present to continuously feed money into the gaming device, initiate each play of the device, and receive any payout from the device. The requirement of a physical presence is not only a hardship on a player, as will be fiber described below, but also results in substantial down-time to the casino owner of the gaming device. While casinos typically have a large capital investment in gaming devices, and particularly slot machines, these devices go unused a large portion of the time. For example, late at night, between successive players, and during inclement weather, are times when such devices may go largely unused.

For a player, a constant presence at a gaming device may comprise both a physical and emotional hardship. For example, a player may wish to leave the gaming device momentarily to have dinner or take a short rest before returning to the machine. In other instances, the player may wish to leave for an extended period to attend a show, play a round of golf, or the like.

Despite wanting to leave the gaming device, the player often will desire to continue playing. Because a player's stay at a casino is limited, a player will often want to maximize the playing time, thereby increasing the chances of winning. For instance, a player may attempt to play at multiple gaming devices at the same time. Moreover, a player often desires to continue playing the same gaming device or devices because the player believes that the chance of winning at a particular device or devices is great.

In response to a desire to physically leave a gaming device yet continue playing it, players have been known to manually "lock-up" a device. Such manual locking-up of a device has typically been achieved by placing a "reserved" sign on the device or, in the case of slot machines, placing a change cup on the pull handle. In theory, by manually locking-up a device, a player prevents others from playing that device until the player returns to resume play.

In practice, however, manually locking-up a gaming device has several disadvantages. Manually locking-up a device is ineffectual as there can be no guarantee that other players will respect the indication that the device is locked-up. Despite the "reserved" sign or the change cup on the handle, another player may still operate the manually locked-up device. During such an apparent lock-up, the device is really reserved, not physically secured. Even if no other player begins play on the locked-up device, the time away from the device is lost; not only has the player lost opportunities to hit a jackpot, but also the owner of the device has lost significant revenue by allowing the device to go unused. Thus, there is a need for a method and system for automated play of a gaming device (or multiple gaming devices) in a continuous gambling mode while the player is away from the device(s).

The game of Keno resembles automated play. A game of Keno consists of matching a series of player-selected numbers against a series of numbers drawn by the Keno system. Once the player has selected the series of numbers, the player selects a certain number of games for which those numbers are valid. Thus, by selecting several games, the player may bet on fixture games without further interaction with the system.

Despite proceeding without interaction between the player and the Keno system, there is neither true automated play nor device lock-up in Keno. The numbers are drawn by the system and broadcast or transmitted to a number of screens throughout an establishment, such as a casino. An unlimited number of players can attempt to match the numbers drawn. Thus, each screen displaying the numbers drawn by the system need not be locked-up. Furthermore, the Keno games continue indefinitely, without regard to either (i) a particular player's status, (ii) a particular player's participation, or (iii) the outcome of a prior game. Thus, while the number drawings in Keno may occur in a continuous manner, there is no automated play for a particular customer.

SUMMARY OF THE INVENTION

A method according to one embodiment of the present invention provides for: receiving a request for an automated session, in which the automated session comprises a plurality of games; initiating a first game of the automated session, the first game corresponding to a first gaming device; and initiating a second game of the automated session, the second game corresponding to a second gaming device.

BRIEF DESCRIPTION OF THE DRAWINGS

FIG. 5 is a schematic view of the automated session database of FIG. 3;

FIG. 6 is a schematic view of the communication device database of FIG. 3;

FIG. 7 is a schematic view of the slot machine database of FIG. 3;

DETAILED DESCRIPTION OF PREFERRED EMBODIMENTS

Figure 1:
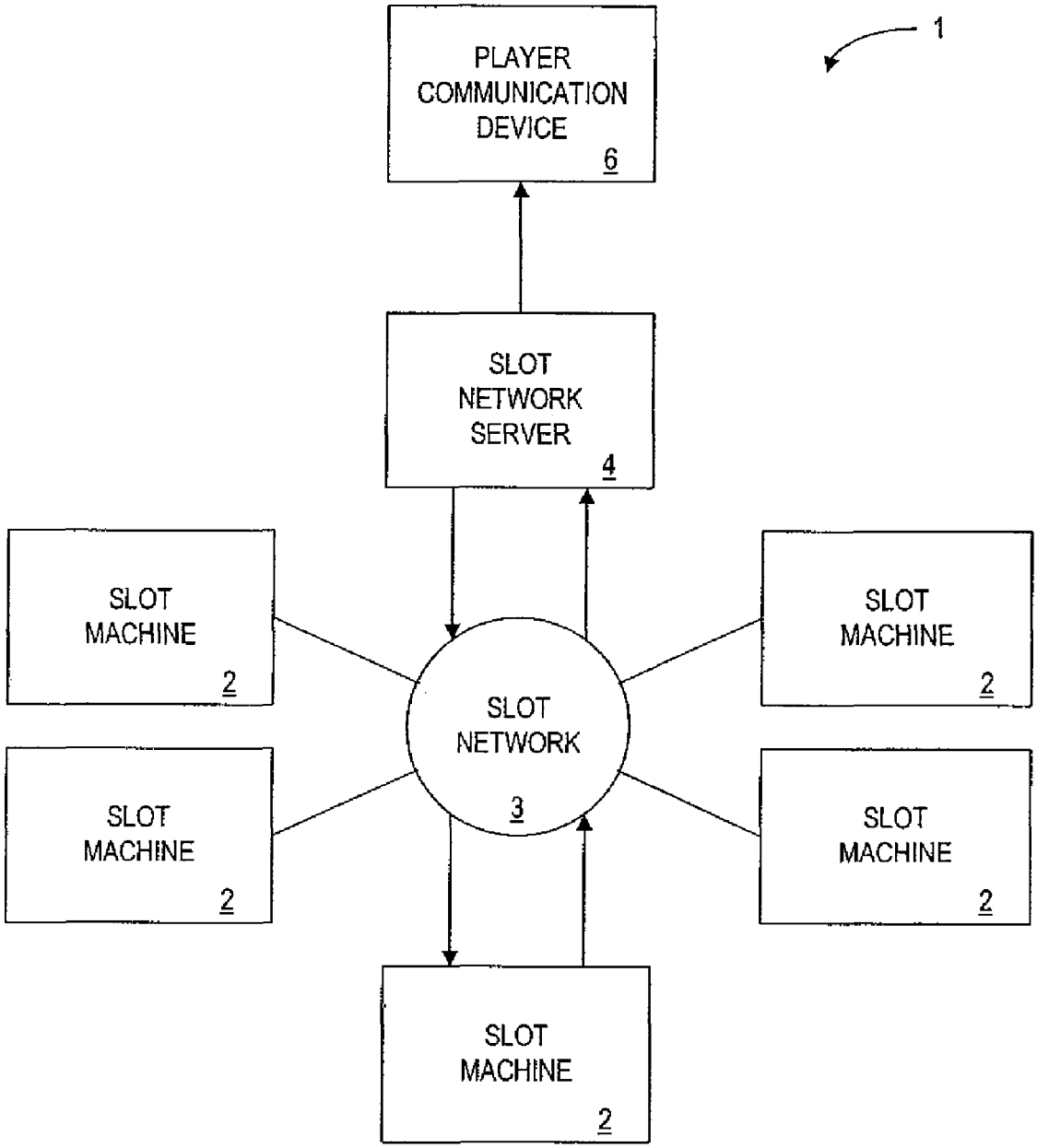
FIG. 1 is an overall schematic view of a system according to one embodiment of the present invention, including a slot machine, a slot network server, and a player communication device.

Various embodiments of the present invention provide a method and apparatus for automated play which permits a casino to recognize substantially increased play time, and hence revenue, from a gaming device. At the same time, these various embodiments satisfy a player's emotional desire to maximize his playing time on a gaming device or devices, while accommodating the physical need to at times be away from the machines.

Various embodiments of the present invention include a gaming device operable to receive a limiting criterion of play, initiate automated play of a gaming device, and terminate automated play of the gaming device upon occurrence of the limiting criterion. In another embodiment of the present invention, the automated play of the gaming device includes repetitive play of the device.

In many instances, the limiting criteria will be the use of the moneys initially authorized for play—i.e., a gaming device, operating in the automated play mode, runs out of money. The present invention further provides a method and apparatus for notifying a player when available credit is running low, permitting a player to visit and place more money in a machine, or to remotely authorize further funds for continued play.

A method according to other various embodiments of the present invention includes the steps of communicating a player parameter selection to a gaming device and initiating automated play of the gaming device. In such embodiments, automated play of the gaming device occurs when the gaming device is unattended by a player.

According to other various embodiments, the method includes the steps of receiving a play option and automatically playing a gaming device according to the play option.

The present invention also includes a gaming device which includes a memory device having a player parameter selection stored therein and a processor in communication with the memory device. The processor is configured to initiate automated play of the gaming device until occurrence of a limiting criterion of play.

Various embodiments of the present invention provide for a slot machine operable to: receive a command to start a game, in which the command is a signal that does not correspond to a manually initiated play; play a game in response to receiving the command; and transmit outcome data corresponding to the game.

Other various embodiments of the present invention receive a request for an automated session, in which the automated session comprises a plurality of games; initiate a first game of the automated session, the first game corresponding to a first gaming device; and initiate a second game of the automated session, the second game corresponding to a second gaming device.

Various embodiments of the present invention provide for receiving outcome data from a plurality of gaming devices and determining which outcomes to include in the player's automated play session based on the player's selection parameters for the automated play session.

Various embodiments of the present invention provide for allowing a player of an automated play session to switch automated play from one gaming device to another during an automated play session. Other various embodiments provide for initiating a game of an automated session at a gaming device that is different from the gaming device into which the player entered an amount of funds for the automated play session.

Various embodiments of the present invention provide for determining an outcome of an automated play session that requires a decision by the player in order to determine a further outcome or a payout and then holding the outcome for a later decision by the player.

Various embodiments of the present invention provide for determining a player associated with an automated play session, selecting a gaming device, and providing the player with an offer of a reward in exchange for the player receiving a payout of the automated play session at the selected gaming device.

Various embodiments of the present invention provide for determining a player and providing to the player an offer of a reward in exchange for the player playing an automated play session.

Various embodiments of the present invention provide for allowing an automated play session to be based on at least one outcome of manual play at a gaming device. A method is thus provided for receiving first outcome data associated with a game initiated by a first player at a gaming device, determining an automated play session associated with a second player, and determining second outcome data for the automated play session based on the first outcome data and a session parameter of the automated play session.

Various embodiments of the present invention provide for maintaining an audit trail for a gaming device and the outcomes of a gaming device whereby the gaming device may be used to provide games to an automated play session of a remote player (or players) while a player at the gaming device may also play the gaming device.

The present invention is directed generally to automated play of a gaming device or devices. In various embodiments, a player enters player identifying information and player parameter selections at a gaming device. The gaming device stores the player parameter selections and proceeds to initiate automated play of the gaming device or of multiple gaming devices.

Such automated play may occur while the gaming device is unattended by the player. In various embodiments, the gaming device is locked-up such that no other player may use the gaming device during automated play. In various other embodiments, the gaming device is not locked-up, allowing a player to play the gaming device even while the gaming device is involved in automated play for a remote player. In this manner, the casino may benefit from increased usage of the gaming device.

Remote communications with the player permit the player engaged in automated play both to enjoy the ongoing play, and to alter any pre-established, limiting criteria, for example relating to finding, by making appropriate adjustments during the course of automated play. In various embodiments of the present invention, such adjustments may be made at a gaming device. In other various embodiments, such adjustments may be made via a communication device. Some limitations may also be altered remotely, through a telephone call or appropriate communication to casino personnel. The automated play session ends upon occurrence of a limiting criterion or upon the manual termination of the automated play session by the player.

Certain preferred embodiments of the present invention will now be described in greater detail with reference to the drawings. Although the embodiments discussed herein are directed to reel slot machines, it should be understood that the present invention is equally applicable to other gaming devices, such as video poker machines, video blackjack machines, or the like.

With reference to FIG. 1, a system 1 according to one embodiment of the present invention is shown. In general, the system 1 comprises multiple slot machines 2, a slot network server 4, and a player communication device 6, such as a pager, handheld display device, set-top display device, or cellular telephone. In the present embodiment, each slot machine 2, which is uniquely identified by a machine identification (ID) number, communicates with the slot network server 4 via a slot network 3. The slot network 3 is preferably a conventional local area network controlled by the server 4. It is to be understood, however, that other arrangements in which the slot machines 2 communicate with the server 4 are within the scope of the present invention.

As will be described in greater detail below, the slot machine 2 communicates player identifying information and player parameter selections to the slot network server 4. The slot network server 4, in turn, may communicate locking data to the slot machine 2. Additionally, the slot machine 2 generates machine messages and outcome data. The slot machine 2 communicates the machine messages and outcome data to the slot network server 4, which, in turn, communicates the information to the player communication device (or communication devices) 6. Communication device 6, for example, a pager including a display, provides sufficient information to permit the player to follow and enjoy the play, and in some cases to authorize necessary or desired changes in the play.

Figure 2:
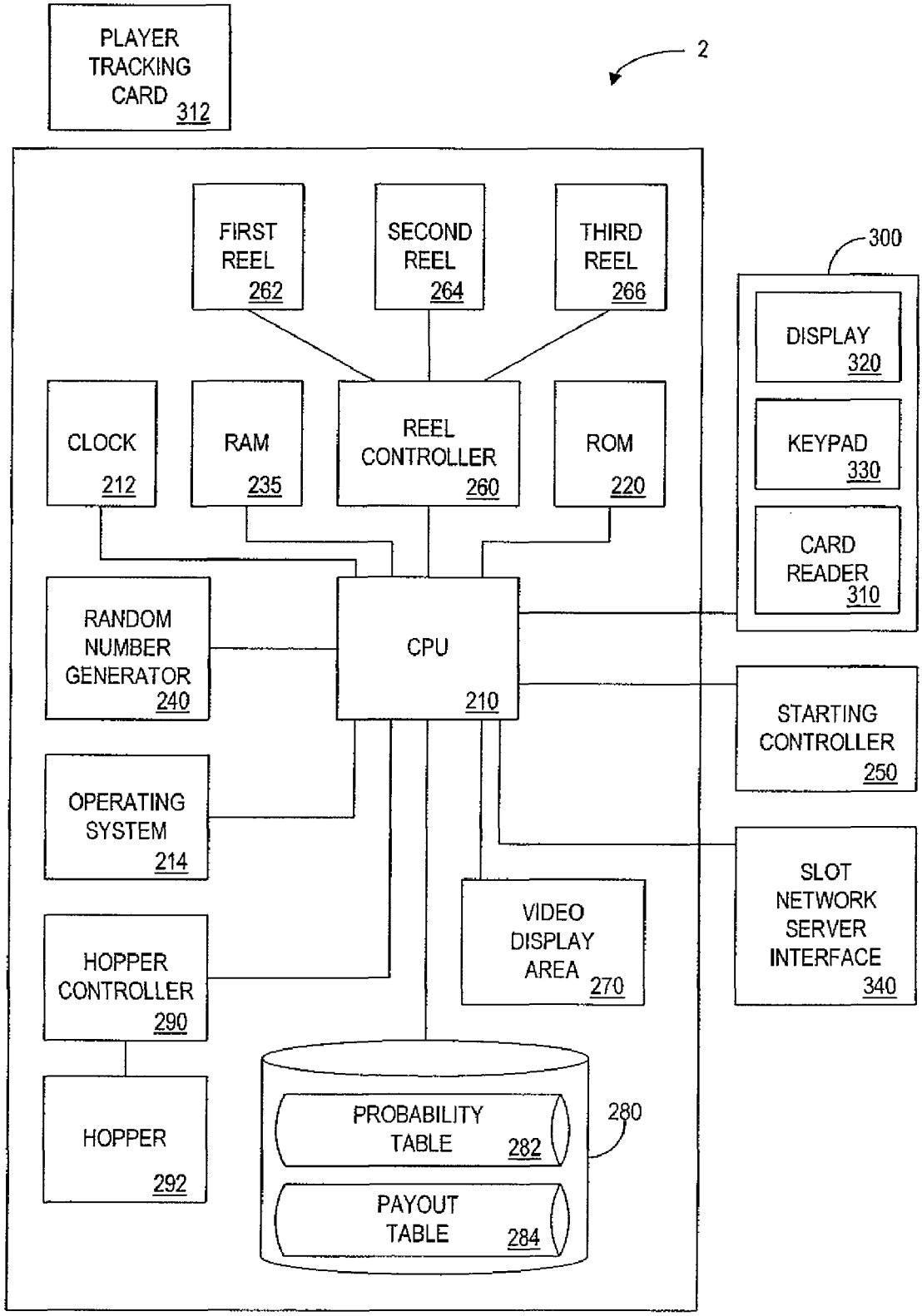
FIG. 2 is a schematic view of the slot machine of FIG. 1.

With reference to FIG. 2, the slot machine 2 will now be described in greater detail. The slot machine 2 contains a Central Processing Unit (CPU) 210, a clock 212, and an operating system 214 (typically stored in memory as software). The CPU 210 executes instructions of a program stored in Read Only Memory (ROM) 220 for playing the slot machine 2. The Random Access Memory (RAM) 230 temporarily stores information passed to it by the CPU 210 during play. Also in communication with the CPU 210 is a Random Number Generator (RNG) 240.

With respect to gaming operations, the slot machine 2 may operate in a conventional manner. The player may start the machine 2 by inserting a coin, or using electronic credit, and pressing the starting controller 250. Under control of a program stored, for example in a storage device 280 or ROM 220, the CPU 210 initiates the RNG 240 to generate a random number. Alternatively, the CPU 210 may be controlled by, or response to, for example, a stored program or a signal from the slot network server 4. In such a situation, the CPU 210 would initiate the RNG 240 to generate a random number at a time other than in response to an attending player pressing the starting controller 250.

The CPU 210 looks up the generated random number in a stored probability table 282 and finds the corresponding outcome. Based on the identified outcome, the CPU 210 locates the appropriate payout in a stored payout table 284. The CPU 210 also directs a reel controller 260 to spin reels 262, 264, 266 and to stop them at a point when they display a combination of symbols corresponding to the selected payout and/or identified outcome. When the player wins, the machine stores the credits in RAM 230 and displays them in video display area 270.

A hopper controller 290 is connected to a hopper 292 for dispensing coins. When the player requests to cash out by pushing a button on the slot machine 2, the CPU 210 checks the RAM 230 to see if the player has any credit and, if so, signals the hopper controller 290 to release an appropriate number of coins into a payout tray (not shown).

In alternative embodiments, the slot machine 2 does not include the reel controller 260 and reels 262, 264 266. Instead, a video display area 270 graphically displays representations of objects contained in the selected game, such as graphical reels or playing cards. These representations are preferably animated to display playing of the selected game.

Also in communication with the CPU 210 is a player tracking device 300. The tracking device 300 may comprise a card reader 310 for reading player identification information stored on, or otherwise indicated by, player tracking card 312. As used herein, the term player identifying information denotes any information or compilation of information that uniquely identifies a player. In the present embodiment, the identifying information is a player identification (ID) number and player name. Although not so limited, the player tracking card 312 of the present embodiment stores the player ID and player name on a magnetic strip located thereon. Such a magnetic strip and device to read the information stored on the magnetic strip are well-known.

The player tracking device 300 also includes a display 320, having a touch screen, or a keypad 330. In operation, as discussed below, the slot machine 2 may display a message prompting the player to enter player parameter selections. In the present embodiment, a player enters the player parameter selections via the display 320 which includes a touch screen. In an alternative embodiment, the player enters the player parameter selections via a keypad 330, which is part of the tracking device 300 and, therefore, in communication with the CPU 210.

Also connected to the CPU 210 is a slot network server interface 340. The network server interface 340 provides a communication path between the slot machine 2, the slot network 3, and the slot network server 4. Thus, as discussed in greater detail below, information may be communicated among the player tracking card 312, player tracking device 300, slot machine 2, and slot network server 4.

In alternative embodiments, the slot machine 2 may contain the communication device 6, which may be detached from the slot machine 2 for remote play. The player may be required to swipe a credit card, provide a credit card number, or to put up a deposit before detaching the communication device 6.

Figure 3:
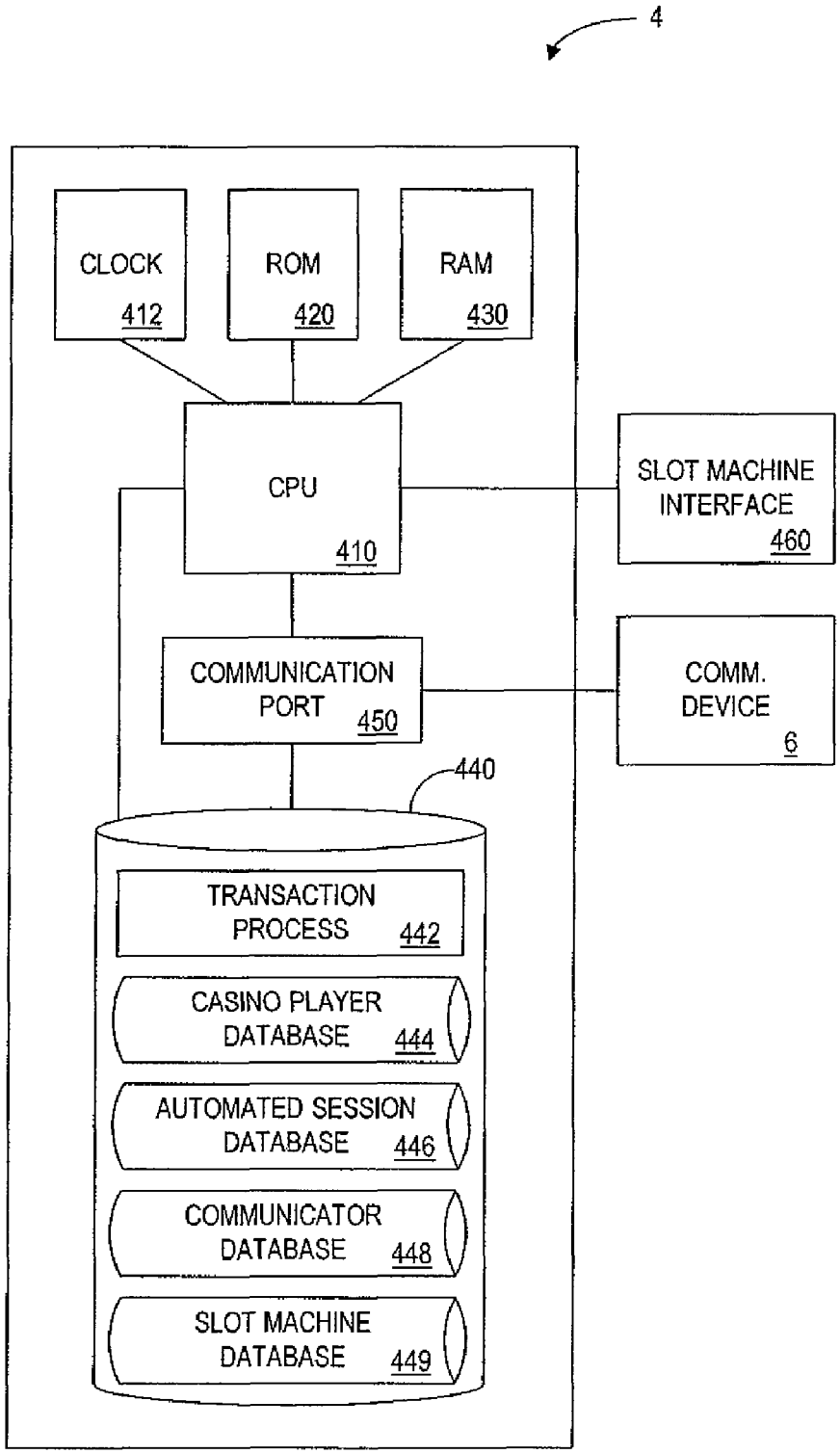
FIG. 3 is a schematic view of the slot network server of FIG. 1, including a player database, automated session database, communication device database, and slot machine database.

With reference to FIG. 3, the slot network server 4 will be described in greater detail. Like the slot machine 2 of FIG. 2, the slot network server 4 has a Central Processing Unit (CPU) 410. The CPU 410, which has a clock 412 associated therewith, executes instructions of a program stored in Read Only Memory (ROM) 420. During execution of the program instructions, the CPU 410 temporarily stores information in the Random Access Memory (RAM) 430.

Additionally, the CPU 410 is coupled to a data storage device 440, having a transaction processor 442, a casino player database 444, an automated session database 446, a communication device database 448, and a slot machine database 449. In general, the transaction processor 442 manages the contents of the data storage devices 440. As discussed in detail below, the player database 444, automated session database 446, the communication device database 448, and slot machine database 449 store information related to player identification, automated operation of the slot machine 2, remote communication to the player's communication device 6, and slot machine outcomes, respectively.

In order to communicate with the communication device 6, the slot network sever 4 also includes a communication port 450. The communication port 450 is coupled to both the CPU 410 and the data storage device 440. Thus, the CPU 410 can control the communication port 450 to receive information from the data storage device 440 and transmit the information to the communication device 6. Note that the communication path between the communication port 450 and the communication device 6 need not be hardwired. As noted above, the communication device 6 is preferably a pager, a handheld device including a display (e.g., such as a PDA), or a cellular telephone, and preferably employs wireless communication.

Lastly, the slot network server 4 includes a slot machine interface 460 coupled to the CPU 410. The slot machine interface 460 allows the slot network server 4 to communicate with the slot machines 2 coupled to the network.

Figure 4:
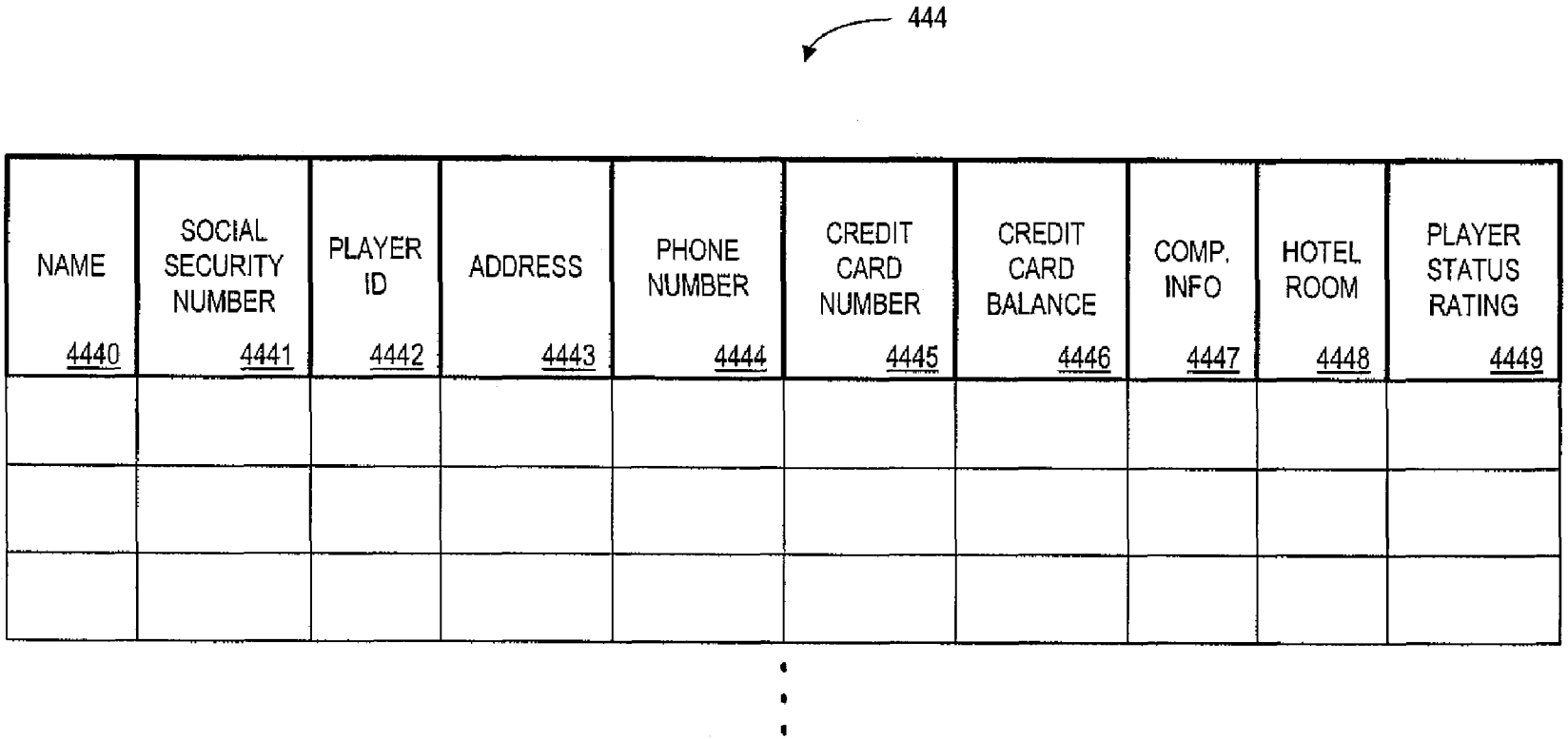
FIG. 4 is a schematic view of the player database of FIG. 3.

The player database 444 of the present embodiment as shown in FIG. 4, includes multiple records having multiple fields of information. Specifically, the player database 444 comprises multiple records, each record being associated with a particular player, as identified by a player identification (ED)) code. The fields within each record include: name 4440, social security number 4441, player ID 4442, address 4443, telephone number 4444, credit card number 4445, credit balance 4446, complimentary information, such as complimentary points awarded 4447, hotel room number 4448, and player status rating 4449. Thus, having information related to one field, such as player ID 4442, allows the slot network server 4 to retrieve or access further information stored in the other fields of that player's record.

It is to be understood that not all of these identifying fields, nor the illustrated design of the player database 444, are necessary for operation of the present embodiment. Specifically, the name 4440, social security number 4441, player ID 4442, address 4443, telephone number 4444, credit card number 4445, and hotel room 4448 fields are merely representative of additional information that may be stored and used for other purposes. For example, in an alternative embodiment, credit card number 4445 and hotel room number 4448 are used for billing purposes and social security number 4441 is used to generate tax forms when a player wins a jackpot over a given amount.

Complimentary points awarded 4447 and player status rating 4449 are further illustrative of additional information a casino may store in a player's record. Thus, in the present embodiment, only the player's name 4440, player ID 4442, and credit balance 4446 are necessary.

The automated session database 446, as shown in FIG. 5, comprises multiple records, each record pertaining to an automated play session of a particular player, as identified by the player ID. Consequently, one field in each record is the player ID field 4460. Other fields include: machine identification (ID) number(s) 4461, start time 4462, end time 4463, maximum number of pulls 4464, limiting credit balance 4465, limiting maximum payout 4466, bet per pull 4467, time between pulls 4468, and communication device number 4469. As will be apparent to one of ordinary skill in the art, since both the player database 444 and the automated session database 446 include a player ID field, 4440 and 4460, respectively, the system 1 can correlate any information stored in the player database 444, corresponding to a particular player, with any information stored in the automated session database 446, corresponding to that same player.

The communication device database 448, as shown in FIG. 6, includes multiple records, each record pertaining to a different communication device 6 as identified by a communication device number as stored in the communication device number field 4480. The additional fields in each record include: communicator identifier 4481, player ID 4482, communicator time out 4483, and communicator time in 4484. Because the communication device database 448 and the automated session database 446 both include a communication device number field 4481, 4469, respectively, information can be correlated between the two databases. Furthermore, because the communication device database 448, like the automated session database 446 and the player database 444, contains a player ID field 4482, the system 1 can correlate information contained within these three databases 444, 446, 448 for a particular player, as identified by the player ID.

In one embodiment of the present invention, the information stored in the communication device database 448 is used to inventory the communication devices 6. The communication time out 4483 represents the time at which a player removed a communication device 6 from a slot machine 2 and the communicator time in 4484 represents the time the communication device 6 was returned to the slot machine 2. Having such information, the slot network server 4 may, at any given time, search the communication device database 448 and determine which communication devices 6 are presently in use. Furthermore, for any communication device 6 that has been out for more than a given period, the server 4 may determine which player, based upon the player ID number in field 4482, last used the device 6. Moreover, based on the player ID number, the server 4 can obtain the information necessary to contact that player from that player's record in the player database 444.

As will be understood by those skilled in the art, the ultimate goal of most slot machine players is to hit a jackpot payout. The enjoyment of the play, as well as the ability to maximize the chance of hitting a large jackpot, is increased by more play. Play can be increased both by playing longer, and by playing faster As will be appreciated from a consideration of the process described below, the present invention permits both increased duration and speed of play.

The slot machine database 449, as shown in FIG. 7, relates to information concerning each slot machine 2. As illustrated, each slot machine 2 has an associated record in the database. Each slot machine 2 is identified by a unique machine ID number, as stored in the machine ID number field 4491. The other fields in the slot machine database 449 include: machine type 4492, machine denomination 4493, maximum coins allowed 4494, payout structure 4495, reel positions 4496, and payout 4497. Because the slot network server 4 may search any field in the slot machine database 449, the server 4 is able to identify a slot machine 2, not only by its machine ID number 4491, but also by the type 4492 and denomination 4493 of the slot machine 2.

Figure 8A:
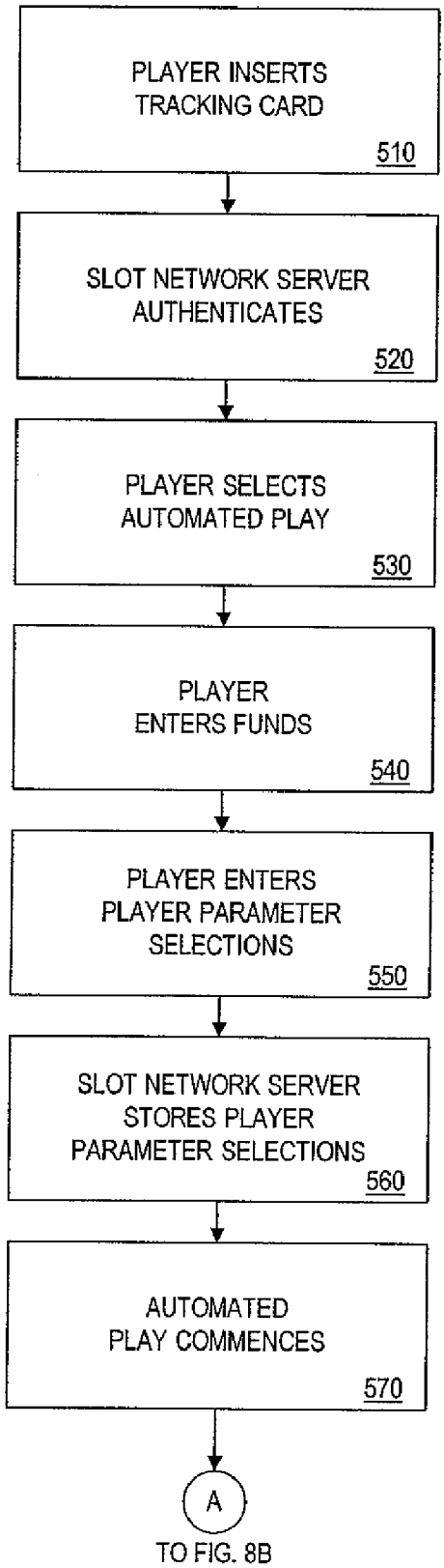
FIGS. 8A and 8B show an overall flow diagram of the operation of the system of FIG. 1.
Figure 8B:
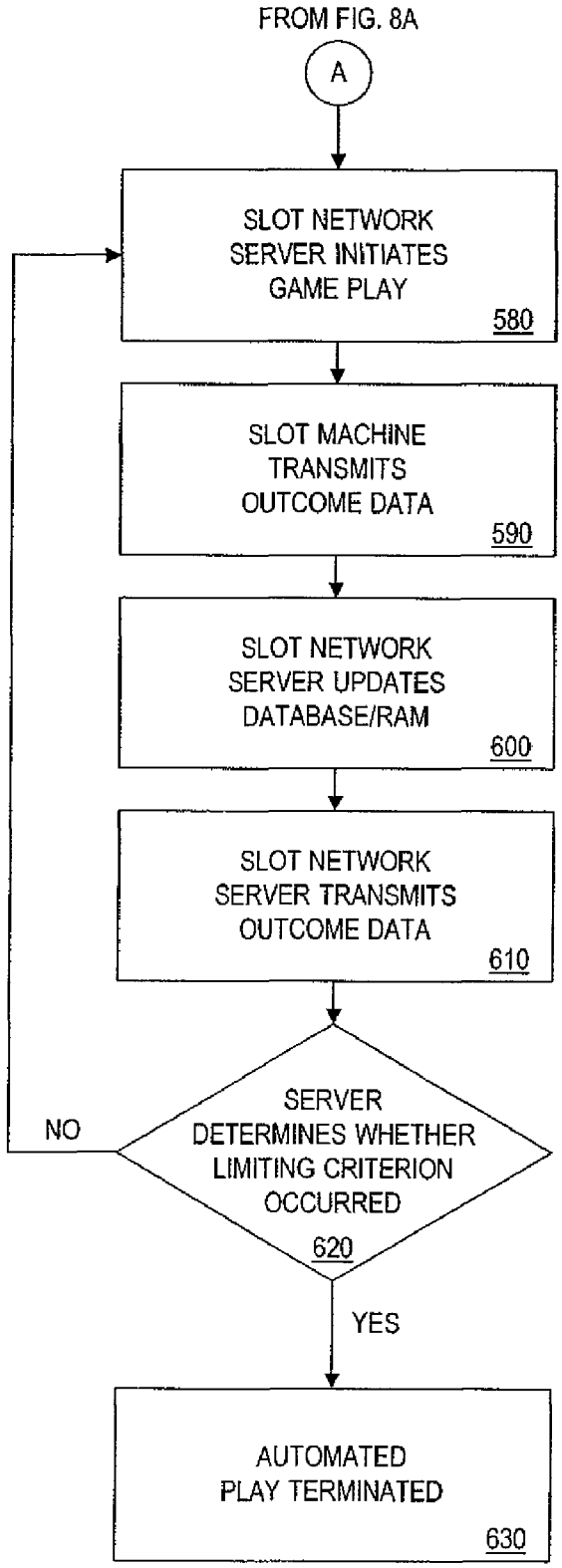

Having thus described the components of the present embodiment, the operation of the system 1 will now be described in greater detail with reference to FIGS. 8A and 8B, and continuing reference to FIGS. 1-7. It is to be understood that the programs stored in ROM 420 of the slot network server 4 and ROM 220 of the slot machine 2 provide the function described below.

As shown at step 510, the slot machine player first inserts the player tracking card 312 into the card reader 310. The card reader 310 then proceeds to read player identifier information from the tracking card 312. The player identifier information, namely the player's name and the player ID, are communicated from the slot machine 2 to the slot server 4. Upon receiving the player identifying information, the slot network server 4 authenticates the information. This step, depicted as step 520, includes the slot network server 4 searching the player database 444 for a record containing the player name and player ID received in the appropriate field 4440, 4442, respectively. Once the slot network server 4 authenticates the player identifying information, the server 4 transmits a signal to the slot machine 2 acknowledging such authentication.

In step 530, the player chooses to select automated slot machine play. According to various embodiments of the present invention, the player may choose to select automated slot machine play after receiving an offer of a reward in exchange for the player participating in an automated play session. The casino may provide such an offer in order to encourage automated play during nighttime hours when use of the slot machines is lower. Alternatively, the casino may provide such an offer during peak hours so as to free up a machine for other players. Of course, the casino may provide a reward for automated play in order to allow another player to use the slot machine manually, or to increase the number of players playing on the slot machine(s), whether remotely or manually (as discussed further below). A reward might be, for example, a bonus payout, a higher payout schedule, a meal compensation, a gift certificate, free credits, or the like.

The slot machine 2 also prompts the player to enter finds for use during the automated play session. Specifically, as shown in step 540, the player enters coins or bills into the slot machine 2. The slot machine 2 registers the total amount of money deposited by the player. The slot machine 2 then transmits a signal to the slot network server 4 indicating the amount of funds deposited by the player. In response, the slot network server 4 accesses the record in the player database 444 corresponding to the particular player and increments the credit balance field 4446 in accordance with the amount of funds deposited.

In the alternative, gaming credits accumulated during non-automated play of the slot machine 2 may be used to fund the automated play session. The slot machine 2, which locally stores the gaming credits in memory, transmits an indication of the amount of credits to the slot network server 4 for addition to the credit balance 4464.

In yet another alternative embodiment, the player, prior to initiating an automated play session, produces the player tracking card 312 at a slot change booth or casino cage and deposits a certain amount of funds. The casino personnel reads the player ID number from the player's tracking card 312 with a card reader and proceeds to access the record in the player database 444 corresponding to that player ID. The cashier then increments the credit balance field 4446 by the amount of finds just deposited.

In step 550 the remote player enters the player parameter selections. More specifically, the slot network server 4 transmits a signal to the slot machine 2 causing the slot machine 2 to display a prompt on the display 320 requesting that the player enter the player parameter selections. As noted above, the player preferably enters the player parameter selections via the touch screen on the display 320. In an alternative embodiment, the player enters the player parameter selection via keypad 330. In yet another alternative embodiment, the player parameter selections are previously stored in a record in the automated session database 446 as identified by the particular player's player ID in field 4460. Alternatively, the player may enter the player parameter selections via communication device 6.

Player parameter selections include both play options and limiting criteria of play. Play options, as used herein, include any information used to define automated play. In the present embodiment, play options include the bet per game or handle pull and time between games or handle pulls, as stored in fields 4467 and 4468 of the automated session database 446. Other play options may include, for example, the type(s) of slot machine(s) to be played. For example, a player might request an automated play session including only games played at slot machines which had produced the most (or, alternatively, the fewest) wins in the last hour. Alternatively, the player may wish to define an automated play session that includes only games played by players from a specific geographic area.

A limiting criterion, on the other hand, is any information that may define the beginning or end of an automated play session. In the present embodiment, limiting criteria include: start time, end time, requested number of games or handle pulls, credit balance, total losses, total winnings, and limiting maximum payout. By definition, the expiration of all available credits/funding for playing the machine will, unless other arrangements are made in advance with the casino, constitute a limiting criteria of play. Similarly, the player may define a specific winning credit value as a limiting criteria of play (e.g., stop playing if a credit of one thousand dollars is ever registered).

Once the slot machine 2 receives the player preference selections, the slot machine 2 transmits the information to slot network server 4. The slot network server 4, as shown in step 560, proceeds to store the player parameter selections in the appropriate fields in the automated session database 446.

In addition to storing the player parameter selections, the slot network server 4 assigns an address in RAM 430 to keep current totals of actual limiting values. An actual limiting value is a value that corresponds to a limiting criterion of play. More specifically, an actual limiting value is the actual, current total of a criterion value necessary to determine whether any of the limiting criteria of play have occurred.

Thus, in the present embodiment, the slot network server 4 assigns an address in RAM 430 to store the number of games or handle pulls that actually occur during automated play. Additionally, the server 4 assigns an address in RAM 430 to store the actual amount of losses or winnings during automated play. Both the actual number of handle pulls and the actual amount of winnings or losses may be actual limiting values.

Furthermore, the current credit balance, which is stored in RAM 430, may also be an actual limiting value. As described below with reference to steps 590, 600 and 620, these actual limiting values are updated during automated play and used to determine whether a limiting criterion has occurred.

The server 4 may also assign an address in RAM 430 to store a time value corresponding to the play option of time between handle pulls 4468.

Next, in step 570, the automated play session commences. In one embodiment of the present invention, the commencement of automated play includes the slot network server 4 transmitting locking data to the slot machine 2. The locking data is a signal that prevents the slot machine 2 from accepting coins and entering manual mode. The locking data may also be a signal that prevents a player from pulling a pull handle or otherwise initiating a manual play of the slot machine 2.

Alternatively, locking data may be sent by slot network server 4, in accordance with the player's preferences, to a different slot machine than the slot machine 2 where the player entered finds and/or session parameters. Locking data may instead be sent by slot network server 4 to more than one slot machine, thereby enabling automated play of multiple locked-up slot machines in one automated session.

The slot network server 4 need not transmit locking data. If so, slot machine 2 is not locked and may be used by any player (including the player for whom automated play has commenced). In this manner, a casino may maximize the use of a particular slot machine (or slot machines).

For example, a typical slot machine 2 is capable of generating random numbers more frequently than a typical player initiates a game at the slot machine 2 (e.g., presses the starting controller 250). Thus, RNG 240 may generate a random number in response to an attending player pressing the starting controller 250 during a manual play, and may also generate a random number for a game of an automated play session while, for example, the spin reels 262, 264, and 266 are spinning for the manual play.

Alternatively, a random number generated by an attending player's manual play of slot machine 250 may be used to determine an outcome and/or a payout of a game of an automated play session. Thus, a single random number may be utilized in determining both an outcome of a game of a remote player's automated play session and an outcome and/or a payout of a game of the attending player. Similarly, a game of an automated play session may utilize the outcome and/or payout of a manually played game.

Thus, according to various embodiments of the present invention, an automated play session may include games played at a single locked-up slot machine, games played at multiple locked-up machines, games played at a slot machine (or slot machines) while the machine is also being manually operated, games played manually at a slot machine (or slot machines), or any combination of the above in accordance with player preferences and/or casino operation preferences.

Automated play may commence in various ways. The server 4 may initiate automated play of the game, as shown in step 580, if the player has entered a start time 4463 as a player parameter selection. Specifically, the slot network server 4 searches the automated session database 446 and compares the time from the clock 412 to the values stored in the start time field 4463 and the end time field 4464. If the internal clock time is equal to or greater than the value stored in the start time field 4463 and less than the value stored in the end time field 4464 (if such a value exists), then the slot network server 4 transmits a signal to the slot machine(s) 2 to initiate play.

Alternatively, the player may choose to begin automated play immediately upon entering the player parameter selections other than a start time 4462.

In step 590, the slot machine 2, having played a game and generated outcome data, as described above with respect to various embodiments, transmits the outcome data to the slot network server 4. Along with the outcome data, the slot machine 2 transmits its machine ID number so that the server 4 can identify from which machine the outcome data came. In various embodiments, multiple slot machines 2 transmit outcome data to the slot network server 2.

Outcome data, as used herein, means any information describing the outcome of a game or handle pull. In the present embodiment, outcome data includes the final position of each reel and the corresponding payout or loss for a given play.

According to various embodiments of the present invention, once the slot network server 4 receives the outcome data, it updates the player database 444 and the slot machine database 449 in step 600. More specifically, the slot network server 4 accesses the slot machine database 449 and updates the record pertaining to the particular slot machine 2, as identified by its machine ID number 4491. The slot network server 4 also accesses the automated session database 446 to determine the bet per pull 4466 for the particular player. Lastly, the slot network server 4 accesses the player database 444 to update the credit balance field 4446 in the player's record. The credit balance field 4446 is decreased by the bet per pull amount and increased by the payout 4497, if any.

In various embodiments, slot network server 4 stores outcome data in conjunction with information identifying the player associated with the outcome. In an embodiment where one player is playing a gambling session at the same time that another player has initiated an automated session at the same slot machine 2, each outcome stored may indicate both players (e.g. by player tracking card number). This allows subsequent audits to account for the fact that although one outcome was generated a corresponding revenue stream may be associated with two players. Alternatively, slot network server 4 may store the above information without the identities.

Once the slot network server 4 receives the outcome data, the server 4 also updates the actual limiting criteria stored in RAM 430, as needed. Specifically, the number of pulls value is incremented by one and the total losses/winnings value is changed to reflect the results of the last game.

In various embodiments of the present invention, the server 4 also stores the time it proceeds to step 610, as indicated by clock 412, as the time value corresponding to the time between handle pulls 4468. The server 4 uses this time value to determine the speed of play. Each subsequent time the system 1 performs the operations of step 600, the server 4 also determines whether, in light of the time between handle pulls 4468, it must delay before continuing to proceed. Specifically, the server 4 retrieves the time between handle pulls 4468 and the previously stored time value. The server only proceeds to step 610 when the current time, as indicated by the clock 412, equals the sum of the time between handle pulls 4468 and the previously stored time value. The server 4 stores the time it proceeds to step 610 as the new time value.

It is anticipated that a player having only a limited time remaining at a casino and a small amount of funds available will enter the minimum allowed time (e.g., "zero") as the time between handle pulls 4468. If such a value is received, the system 1 proceeds to continuously generate outcome data without delay, or with a minimal amount of time between generated outcomes, until a limiting criterion of play occurs. For example, the player enters the minimum allowed time as the time between handle pulls 4468 in step 550 and likely remains at the slot machine 2 to watch the slot machine 2 rapidly play game after game until, for example, the player is out of funds or wins a jackpot.

In various alternative embodiments of the present invention, the slot network server 4 compares received outcome data with a player's session parameters to determine if the game corresponding to the received outcome data should be included as a game in the player's automated play session. For example, a player may choose to include all games from a particular type of slot machine in his automated play session. Thus, when the slot network server 4 receives outcome data corresponding to a game (whether automated or initiated manually) at a slot machine 2, it may include the game as part of the player's automated play session if the slot machine 2 is of the correct type.

Once the slot network server 4 receives the outcome data and updates the databases, the server 4 transmits the results of the play to the remote player communication device 6. The results communicated in step 610 to the player communication device 6 may include the actual reel position 4496, the payout of a particular game 4496, the player's current credit balance 4446, and any other information stored or generated by the system 1.

Alternatively, the results may be stored by the server 4 and communicated, for example, at a specific time, periodically, upon the player's request, or in accordance with a player's selection parameters. Similarly, the results, once received by the communication device 6, may be stored and displayed, for example, at a specific time, periodically, upon the player's request, or in accordance with a player's selection parameters.

The slot network server 4 establishes communication with a communication device 6 that is associated with the particular player. Specifically, the server 4 accesses the communication device database 448 and searches for the communication device number 4480 equal to that stored in the player's record in the automated session database 446 in field 4469. The server 4 then uses the communication identifier 4481, which is the pager or cellular telephone number, or the internet protocol (IP) address of a set-top device, to establish communication with the communication device 6.

Note that in various embodiments, more than one communication device 6 may be associated with the particular player. Thus, results may be transmitted to a player's cellular telephone, PDA, pager, and/or other devices, for example, on a player's "buddy list".

As described above, in one embodiment of the invention communication device 6 comprises a pager with a liquid crystal or other type of display. This communication of the outcome data to the player, which may even include a display of the reel position outcome on the display, permits a player to enjoy the excitement of the play without a physical presence at the device. Further, such essentially real-time communication with the slot machine permits a player to adjust the limiting criteria to maximize enjoyment and potential return, typically by increasing the speed and duration of play.

In one aspect of the invention, the remaining credit balance is communicated to the player along with the outcome data. Thus, when a player notes that his play may be terminated because his credit balance is running out, he has the opportunity to increase the credit balance. Preferably, the player will return to a slot machine and add further moneys. If returning to a slot machine is not convenient, the player can increase the credit balance by phoning the casino and authorizing the casino personnel to increase the credit balance. The casino personnel will appropriately enter the additional finds into the correct server database fields. If returning to a slot machine is convenient, the player may choose simply to return to the machine and add more coins. Alternatively, the player may increase the credit balance by sending a command to the casino, the slot machine 2, the server 4, or other device, via, e.g., a two-way pager or touch-tone wireless telephone.

In step 620, having just completed one play, the slot network server 4 determines whether a limiting criterion has occurred. Specifically, in the present embodiment, the slot network server 4 accesses the record in the automated session database 446, as identified by the player's ID 4460, to determine whether any one of the limiting criteria have occurred.

The determination of whether any of the limiting criteria have occurred may be made by various comparisons, for example, by comparing any of: 1) the end time 4464 to an internal clock of the server 4; 2) the maximum number of pulls 4464 to the actual number of pulls stored in RAM 430; 3) the current credit balance 4446 to the limiting credit balance 4465; and 4) the limiting maximum payout 4466 to the actual payout 4497. If none of the limiting criteria have occurred, operation of the system 1 proceeds from step 580, once again.

If any one of the limiting criteria has occurred, then, in step 630, the slot network server 4 stops the automated play session and transmits a signal to the communication device 6, thereby notifying the player that the automated session has ended. If the slot machine 2 was locked-up during the automated session, it may remain locked-up until the player returns. In an alternative embodiment, the slot network server 4 also transmits an unlocking signal to the slot machine 2 upon the occurrence of a limiting criterion of play. The unlocking signal indicates to the slot machine 2 that it may accept coins and allow other players to commence play.

In yet another embodiment, information other than outcome data, such as machine messages, is communicated to the communication device 6. Machine messages, as used herein, include information generated by the slot machine 2 relating to the status of that particular slot machine 2. For example, such a machine message may indicate that the slot machine 2 has stopped functioning properly, is being played manually, or is being played automatically by another player.

In yet another embodiment of the present invention, limiting criteria of play, actual limiting values, or both, are communicated to the player. For example, the player will be notified of the current credit balance 4446 and the limiting credit balance 4465, as well as the current number of pulls; as stored in RAM 430, and the maximum number of pulls 4464 allowed.

In an alternative embodiment, the outcome data transferred in step 590 of FIG. 8 need only include the payout 4497, if any. In such an alternative embodiment, the slot machine 2 communicates only the payout information to the slot network server 4. The server 4, in turn, accesses a slot machine database 449 and, based upon the machine ID number transmitted, accesses a record for that slot machine 2. A payout structure for that particular slot machine 2 is maintained within the record. The payout structure, like the payout table 284 in the slot machine 2, correlates the payout received from slot machine 2 to a possible reel result.

For example, if reels 262, 264, 266 of the slot machine 2 reveal "cherry-cherry-bar," the slot machine 2 may determine that, according to the payout table 284, the player should receive a payout of ten coins. The slot machine 2 then communicates to the slot server 4 a payout of ten coins. The server 4, by a accessing the payout structure, correlates the payout of ten coins back into the reel positions of "cherry-cherry-bar." Because several reel positions may correspond to the same payout, the slot network server 4 may determine that a reel position other than "cherry-cherry-bar" occurred. Thus, the server 4 simulates the actual outcome of the slot machine 2 for transmission to the player's communication device 6.

It will be appreciated by those skilled in the art that, while the player may select player parameter selections in the manner described above, the casino may also set guidelines on the automated operation of the slot machines. In general, the casino is desirous of maximizing play on, and hence revenue from, each machine. Thus the casino may limit the selectable range of player parameter selections, for example the frequency of handle pulls, to insure reasonably constant and speedy play. Further, the casino may alter the range of player parameter selections, and even the fundamental operation of the machines, to encourage play during times when the machine is otherwise underutilized. For example, the casino may permit a machine to be played during late night hours, in an automated mode, at a slower speed and with a higher payout schedule. This would permit a player to start automated play during the nighttime hours when the machine would be otherwise unused. The casino hours would benefit from increased play and revenue, while the player would benefit from potentially better payouts.

Figure 9:
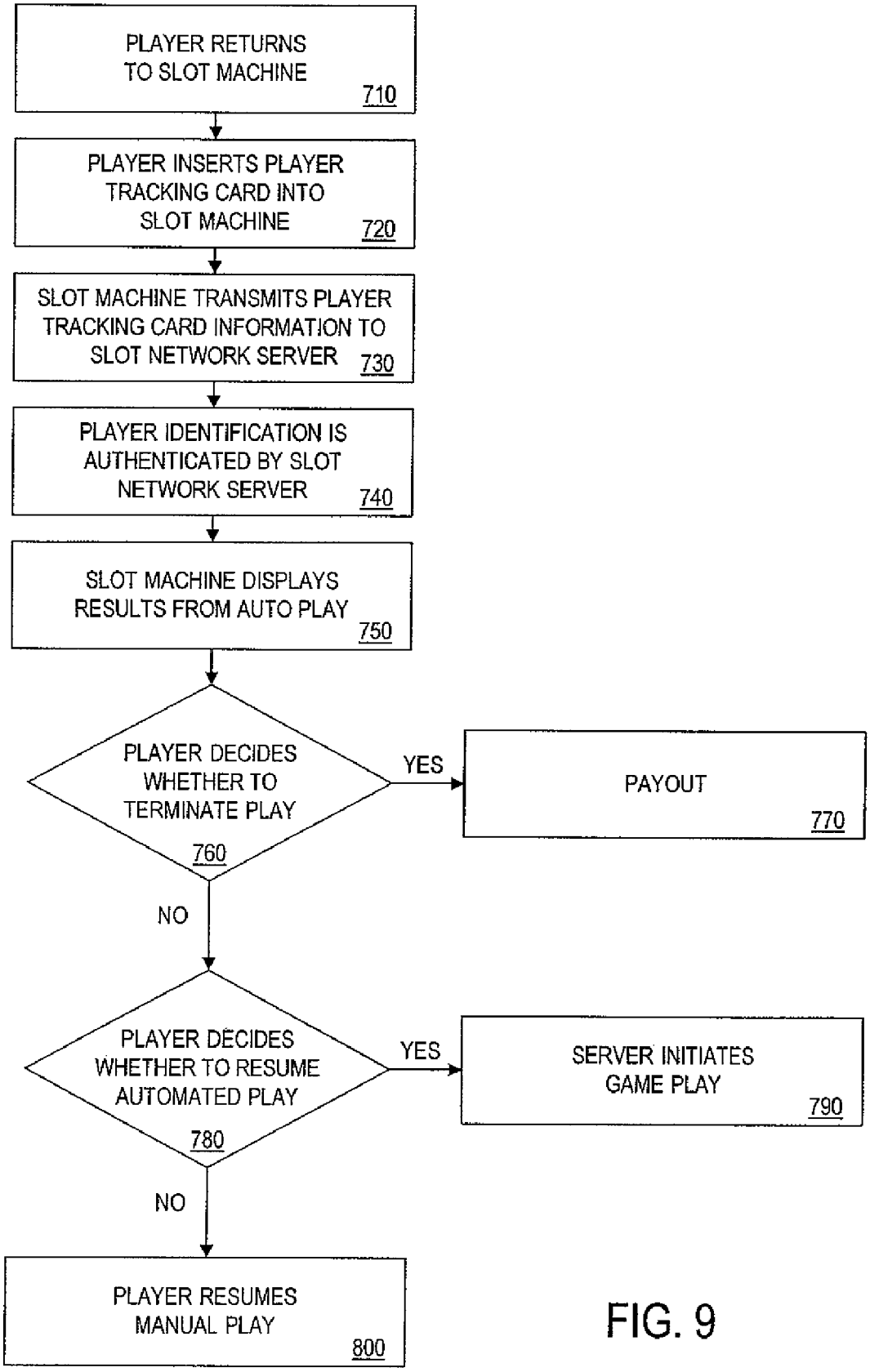
FIG. 9 is a flow diagram of the system of FIG. 1, illustrating termination of automated play.

At any time during the operation of the system 1, as described with reference to FIG. 8, the player may return to the slot machine 2 and manually terminate automated play. Such manual termination of automated play will now be described with reference to FIG. 9.

Upon returning to the machine 2, as shown in step 710, the player, in step 720, inserts the player tracking card 312 into the card reader 310. The card reader 310 reads the player identifying information from the player tracking card 312 and, in step 730, the slot machine 2 transmits this player identifying information to the slot network server 4.

In step 740, the slot network server authenticates the player identifying information. Specifically, the slot network server 2 searches the automated session database 446 to determine whether the player ID number and the machine ID number just received are also present in a single record in the automated session database 446. If the information is present in a single record in the automated session database 446, the player identifying information is deemed authentic.

In an alternative embodiment, the player may terminate his automated play session by returning to any available slot machine 2, regardless of whether the slot machine 2 was involved in the automated play session. Accordingly, the player identifying information may be deemed authentic if the player ID number is in at least one record in the automated session database 446.

Having authenticated the player identifying information, the slot network server 4 transmits the results from the automated play to the slot machine 2 for display to the player in step 750. The results, which are displayed on display 320 or, alternatively, video display area 270, preferably include the player's credit balance 4464. The displaying of the results may also include, for example, all of the resulting reel positions or only the winning reel positions. These results may also be made available to the player via the communication device 6. Having read the results from the automated play session, as shown as step 760, the player may then decide to terminate play. In step 770, if the player decides to terminate play, then the player may receive a payout owed.

It will be understood that, should the player so desire, a complete audit of the automated play session is available through an appropriate examination of the contents of slot machine database 449. Such an audit would typically be provided by casino personnel upon special request by the player, and could include a complete reporting of results for every play during the automated session.

On the other hand, if the player decides not to terminate play, then the player must decide whether to resume automated play, as shown in step 780. If the player decides to resume automated play, such play will continue as described with reference to FIG. 8, steps 580-630, until a limiting criterion occurs or the player returns to manually terminate play. The resumption of automated play is shown as step 790.

As an alternative to resuming automated play, the player may decide instead to resume manual play of the slot machine 2. Step 800 illustrates the resumption of manual play.

As shown in step 770, the player may receive any payout 4497 due. Receiving the payout may involve the slot machine 2 dispensing the amount of coins equal to the credit balance 4464 for the player. Note that the slot machine 2 may or may not be the same slot machine at which the player initiated his automated play session. In an alternative embodiment, the payout involves the player returning to the slot change booth or casino cage and presenting the player tracking card 312. The casino personnel proceed to read the player ID and player name from a player tracking card 312. Upon verifying the player's identification with a secondary form of ID, such as a driver's license, the personnel access the player database 444. The casino personnel proceed to pay the player any amount less than or equal to the current credit balance 4446 stored in the player's record. The personnel then adjust the credit balance 4446 to reflect the disbursement.

In another alternative embodiment, the player may receive a prize or reward in lieu of the payout 4497 due. For example, the casino may offer the player a free hotel stay in lieu of the payout 4497 due. Such an offer may be communicated to the player, for example, by the casino personnel, via the communication device 6, or via the display 320 of the slot machine 2. Of course, such an offer may be communicated via the communication device 6 during automated play.

It is to be understood that the present invention is not limited to an embodiment including both the slot machine 2 and the slot network server 4. Specifically, in one embodiment of the present invention, a slot machine alone stores the automated play information, including player identifying information, credit balance, player parameter selections, and actual limiting values. Moreover, the slot machine not only generates outcome data, but also, rather than employing a server, internally updates the information as described above.

Furthermore, the present invention encompasses automated play of gaming devices that require a player to make decisions during play, such as video blackjack machines, video poker machines, and the like. The inclusion of decision rules in the player parameter selections accounts for the need to make decisions. Alternatively, decision rules may be applied to all players or may be otherwise outside of the control of the player. For example, all players playing an automated play session, or a certain subset of such players, may be forced to play according to a predetermined set of decision rules. Decision rules dictate the course of play based upon the current status of play. For example decision rules for automated play of a video blackjack machine include staying when the dealer shows a "six" and playing according to the highest odds of winning. In short, because decision rules obviate the need for player decisions, automated play may proceed.

In an alternative embodiment, outcomes requiring a decision by the player may be stored and displayed to the player at a later time, for example, when the player returns to the slot machine 2, or via the communication device 6 at the player's request. After the outcome requiring a decision is stored, automated play may then continue with the next game. For example, some outcomes of reel slot machine games require the player to make a selection in a bonus round. In accordance with this alternative embodiment, then, automated play could continue without the player's selection. The player could then play all the stored bonus round outcomes requiring the player's selection at a later time.

There has thus been provided a method and apparatus of operating a gaming device, for example a slot machine, in an automated manner. The present invention permits a casino to significantly increase the usage and revenue of such gaming devices, encouraging substantially continuous play at times when the machine might otherwise be un- or under-used. The invention further pen-nits a player to enjoy all of the benefits of gambling, such as the enjoyment of viewing real-time gaming device results, without necessitating a physical presence at the machine. Additionally, the invention permits the casino to offer better-than-normal playing parameters, such as an improved payout schedule, or even the special reservation of a selected machine during normal playing hours.

Although the present invention has been described in terms of certain preferred embodiments, other embodiments that are apparent to those of ordinary skill in the art are also intended to be within the scope of the present invention. Accordingly, the scope of the present invention is intended to be limited only by the claims appended hereto.

What is claimed is:

1. A gaming system comprising:

a gaming device including:

at least one input device, at least one display device, at least one processor, and at least one memory device which stores a plurality of instructions, which, when executed by the at least one processor, cause the at least one processor to operate with the at least one display device, the at least one input device, and a communications network to:

(a) receive a request to remotely display at least one outcome of at least one play of a wagering game, (b) upon receiving said request, lock said gaming device, (c) after locking, determine the at least one outcome of the at least one play of the wagering game, (d) after determining the at least one outcome of the at least one play of the wagering game, unlock said gaming device, and (e) output data indicative of the at least one outcome to the communications network; and a portable communication device configured to operate with the communications network to:

(a) receive the data indicative of the at least one outcome of the at least one play of the wagering game from the communications network, and (b) upon receipt of the data indicative of the at least one outcome, display a representation of the at least one outcome.

2. The gaming system of claim 1, further comprising a server configured to operate with the communications network to communicate with the portable communication device and the gaming device.

3. The gaming system of claim 2, at least one of the server and the gaming device being configured to authorize the portable communication device to generate the request to remotely display the at least one outcome of the at least one play of the wagering game to a player upon a determination that the player has provided a payment in exchange for the at least one play of the wagering game.

4. The gaming system of claim 2, the server being configured to:

receive, from the gaming device over the communications network, the data indicative of the at least one outcome;

store the data indicative of the at least one outcome; and transmit the data indicative of the at least one outcome to the portable communication device over the communications network.

5. The gaming system of claim 4, the server being configured to wirelessly transmit the data to the portable communication device over the communications network.

6. The gaming system of claim 4, the gaming device being associated with a first identifier that uniquely identifies the gaming device and the portable communication device is associated with a second identifier that uniquely identifies the portable communication device.

7. The gaming system of claim 6, the server storing an association of the first identifier with the second identifier in a database, the data indicative of the at least one outcome received by the server including the first identifier.

8. The gaming system of claim 7, the server being configured to transmit the data to the portable communication device by:

determining, the first identifier of the data indicative of the at least one outcome;

determining the second identifier associated with the first identifier; and transmitting the data indicative of the at least one outcome to the portable communication device based on the determined second identifier.

9. The gaming system of claim 6, second identifier including a communication identifier configured to facilitate communication with the portable communication device via the communications network.

10. The gaming system of claim 2, the server being configured to initiate automated play of the gaming device and to transmit the data indicative of the at least one outcome of the at least one play of the game resulting from the automated play to the portable communication device.

11. The gaming system of claim 1, the gaming device being configured to output the data indicative of the at least one outcome by transmitting the data to the portable communication device.

12. The gaming system of claim 1, the data indicative of the at least one outcome including an indication of a payout amount associated with the at least one outcome.

13. The gaming system of claim 12, the gaming device being a slot machine and the indication of the payout amount including an indication of a position of a reel along a payline, as the position of the reel corresponds to the payout amount.

14. The gaming system of claim 1, the portable communication device being configured to determine and display an indication of a credit balance as said credit balance is affected by the data indicative of the at least one outcome.

15. The gaming system of claim 1, the portable communication device being configured to receive the data indicative of the at least one outcome and display the representation of the at least one outcome in real time as the gaming device determines the at least one outcome.

16. The gaming system of claim 1, the portable communication device being configured to receive the data indicative of the at least one outcome at a designated time.

17. The gaming system of claim 1, the portable communication device being configured to receive the data indicative of the at least one outcome at a designated time after data indicative of at least one previously determined outcome was received.

18. The gaming device of claim 1, the portable communication device being configured to receive the data indicative of the at least one outcome upon a request by a player to view the representation of the at least one outcome.

19. The gaming system of claim 1, the data indicative of the at least one outcome received by the portable communication device including data indicative of a plurality of outcomes determined by at least the gaming device.

20. The gaming system of claim 1, the portable communication device being configured to store the data indicative of the at least one outcome upon receiving said data.

21. The gaming system of claim 20, the portable communication device being configured to receive the data indicative of the at least one outcome and store said data at a first time, and to display the representation of the at least one outcome at a second time.

22. The gaming system of claim 1, wherein the portable communication device is further operable being configured to display the representation of the at least one outcome at a designated time.

23. The gaming system of claim 1, wherein the portable communication device being configured to display the representation of the at least one outcome after a designated period of time after following a display of a representation of at least one previously determined outcome.

24. The gaming system of claim 1, wherein the portable communication device being configured to display the representation of the at least one outcome upon a request by a player to view said representation.

25. The gaming system of claim 1, the portable communication device being configured to display the representation of the at least one outcome in accordance with at least one selection parameters associated with a player.

26. The gaming system of claim 1, the portable communication device being configured to display the representation of the at least one outcome as a presentation including multiple distinct portions, each portion indicating a distinct outcome of one of the at least one play of the wagering game.

27. The gaming system of claim 1, the portable communication device being at least one selected from the group consisting of: a pager, a handheld display device, a set-top display device, and a cellular telephone.

28. The gaming system of claim 1, portable communication device being configured to receive a message other than said data indicative of the of the at least one outcome and to display an indication of said message.

29. The gaming system of claim 28, the message relating to a status of the gaming device.

30. The gaming system of claim 28, the message relating to a status of an automated game session.

31. The gaming system of claim 28, the message including an offer to a player, the offer defining a benefit in exchange for the a forfeiture of a payment due to the player.

32. The gaming system of claim 31, the benefit including a reduction in a price for a stay at a hotel associated with a casino in which the gaming device is located.

33. The gaming system of claim 28, the message including an indication of a decision to be made by a player, the decision affecting a final resolution of the at least one play of the game.

34. The gaming system of claim 33, wherein the decision relates to a bonus round.

35. The gaming system of claim 28, the portable communication device being configured to store the message at a first time and to display the message at a second time, the second time being different from a time when the message was received.

36. The gaming system of claim 1, the gaming device being configured to determine the at least one outcome by receiving an input from a player and determining the at least one outcome based at least in part on said input.

37. The gaming system of claim 36, the gaming device including a player interface, the gaming device being configured to receive the input from the player via the player interface.

38. The gaming system of claim 37, wherein the player interface comprises a touch screen.

39. The gaming system of claim 36, the portable communication device including a player interface, the gaming device configured to receive the input from the player via the player interface of the portable communication device, which input is transmitted to the gaming device over the communications network.

40. The gaming system of claim 36, wherein the player is associated with the portable communication device, and wherein the input is received prior to the player becoming associated with the portable communication device.

41. The gaming system of claim 36, wherein the input comprises an indication of at least one play option.

42. The gaming system of claim 41, wherein the at least one play option comprises information used to define automated play of the gaming device.

43. The gaming system of claim 42, the information used to define the automated play of the gaming device relating to at least one selected from the group consisting of: a wager per game, an amount of time between games, a type of gaming device to be played remotely, and a characteristic of the gaming device to be played remotely.

44. The gaming system of claim 36, the input including at least one limiting criterion applicable to the at least one of play of the wagering game.

45. The gaming system of claim 44, the limiting criterion of play including information that defines a beginning or an end of an automated play session spanning the at least one play of the wagering game.

46. The gaming system of claim 45, the limiting criterion of play including at least one selected from the group consisting of: a start time, an end time, a requested number of games, a total loss amount, a total winnings amount, a minimum credit balance, a maximum credit balance, and a maximum payout.

47. The gaming system of claim 36, the gaming device being configured to receive data indicative of an adjustment of the at least one limiting criterion of play from the player via the portable communication device after outputting the data indicative of the at least one outcome.

48. The gaming system of claim 1, the portable communication device being configured to wirelessly communicate with the gaming device via the communications network.

49. The gaming system of claim 1, the portable communication device comprises including a detachable accessory device of the gaming device, wherein detaching said portable communication device enables remote play of the gaming device.

50. The gaming system of claim 49, the portable communication device being configured enable remote play of the gaming device upon a determination by the gaming device that the player has provided a payment in exchange for the remote play.

51. The gaming system of claim 49, further comprising a server configured to communicate with the gaming device, the server being operable to:

determine a first time at which the player detached the portable communication device from the gaming device; and determine a second time at which the player returned the portable communication device to the gaming device.

52. The gaming system of claim 51, the server being configured to determine, based on the first time and the second time, whether the portable communication device is in use.

53. The gaming system of claim 51, the server being configured to determine a player identifier of the player upon the player detaching the portable communication device.

54. The gaming system of claim 53, the player identifier of the player being stored in a player database, the player database including contact information associated with the player, the server being configured to:

determine that a period of time that has elapsed since the first time is greater than a predetermined period of time; and in response to said determination that the period of time that has elapsed is greater than the predetermined period of time, contact the player using the contact information associated with the player using the player identifier of the player.

55. The gaming system of claim 54, the server being configured to communicate with the portable communication device and being configured to contact the player by outputting a message to the player via a display element of the portable communication device.

56. The gaming system of claim 53, the server being configured to determine the player identifier of the player based on a player tracking card provided by the player upon detaching the portable communication device from the gaming device.

57. The gaming system of claim 1, the portable communication device including an interface which enables a player to authorize changes to one of the at least one play of the wagering game of the gaming device.

58. The gaming system of claim 1, the gaming device being configured to determine the at least one outcome of the at least one play of the wagering game by determining at least one random number and by determining the at least one outcome based on the at least one random number.

59. The gaming system of claim 1, the gaming device being configured to determine the at least one outcome of the at least one play of the wagering game during an automated play session of the gaming device, the at least one outcome representing a single outcome of the automated play session.

60. A gaming system comprising:

a gaming device comprising:

a controller configured to:

(i) receive a request to determine an outcome of a wagering game, (ii) upon receiving said request, lock the gaming device, (iii) after locking, determine the outcome of the wagering game, and (iv) after determining the outcome of the wagering game, unlock the gaming device, and a player interface configured to display an indication of the outcome of the wagering game; and a portable communication device, configured to enable remote play of the wagering game of the gaming device.

61. The gaming device of claim 60, the portable communication device being configured to enable facilitate remote play the wagering game of the gaming device by displaying the outcome of the wagering game upon receiving an indication of the outcome from the controller.

62. The gaming system of claim 60, the portable communication device being configured to enable remote play the wagering game of the gaming device by displaying at least one results of an automated play session conducted on the gaming device.

63. The gaming system of claim 60, the portable communication device being detachable from the gaming device.

64. The gaming system of claim 63, the gaming device being configured to receive a request to remotely play the wagering game of the gaming device via the portable communication device and authorize the request.

65. The gaming system of claim 64, the gaming device being configured to authorize the request upon verifying that an appropriate payment for the requested play of the wagering game has been received.

* * * * *

UNITED STATES PATENT AND TRADEMARK OFFICE

CERTIFICATE OF CORRECTION

PATENT NO. : 7,753,792 B2
APPLICATION NO. : 11/422817
DATED : July 13, 2010
INVENTOR(S) : Walker et al.

It is certified that error appears in the above-identified patent and that said Letters Patent is hereby corrected as shown below:

IN THE CLAIMS:

In Claim 22, Column 19, Line 2, delete "further operable".

In Claim 25, Column 19, Line 17, replace "parameters" with --parameter--.

In Claim 28, Column 19, Line 27, replace "claim 1, portable" with --Claim 1, the portable--.

In Claim 28, Column 19, Line 29, replace "indicative of the of the at least one" with --indicative of the at least one--.

In Claim 44, Column 20, Lines 17-18, replace "at least one of play" with --at least one play--.

In Claim 62, Column 22, Lines 21-22, replace "at least one results" with --at least one result--.

Signed and Sealed this

Fifth Day of October, 2010

David J. Kappos

David J. Kappos
*Director of the United States Patent and Trademark Office*